US008066345B2

(12) United States Patent
Komori et al.

(10) Patent No.: US 8,066,345 B2
(45) **Date of Patent: *Nov. 29, 2011**

(54) METHOD FOR SETTING UP DRIVE SIGNAL

(75) Inventors: Sadaharu Komori, Shiojiri (JP); Takeshi Ito, Suwa (JP); Kei Hiruma, Chino (JP); Satoru Katagami, Hara (JP); Takahiro Imai, Chino (JP); Toru Igarashi, Fujimi (JP)

(73) Assignee: Seiko Epson Corporation (JP)

( * ) Notice: Subject to any disclaimer, the term of this patent is extended or adjusted under 35 U.S.C. 154(b) by 2 days.

This patent is subject to a terminal disclaimer.

(21) Appl. No.: 12/369,254

(22) Filed: Feb. 11, 2009

(65) Prior Publication Data

US 2009/0207201 A1 Aug. 20, 2009

(30) Foreign Application Priority Data

Feb. 14, 2008 (JP) ..... 2008-033238

(51) Int. Cl.
*B41J 29/38* (2006.01)
*B41J 29/393* (2006.01)

(52) U.S. Cl. ..... 347/14; 347/11; 347/19

(58) Field of Classification Search ..... 347/14
See application file for complete search history.

(56) References Cited

U.S. PATENT DOCUMENTS

| | | | | |
|---|---|---|---|---|
| 5,157,411 | A * | 10/1992 | Takekoshi et al. | 347/13 |
| 5,847,723 | A * | 12/1998 | Akahira et al. | 347/14 |
| 6,086,190 | A | 7/2000 | Schantz et al. | |
| 6,530,640 | B1 | 3/2003 | Vega et al. | |
| 6,893,103 | B2 | 5/2005 | Okada et al. | |
| 7,073,727 | B2 | 7/2006 | Usuda | |
| 2002/0093545 | A1 * | 7/2002 | Shirakawa | 347/15 |
| 2003/0071138 | A1 * | 4/2003 | Usuda | 239/101 |
| 2003/0142167 | A1 | 7/2003 | Nakamura et al. | |
| 2004/0027405 | A1 * | 2/2004 | Stoessel et al. | 347/19 |
| 2006/0033768 | A1 * | 2/2006 | Uraki et al. | 347/14 |
| 2007/0109342 | A1 * | 5/2007 | Kato | 347/19 |
| 2007/0182773 | A1 * | 8/2007 | Kim et al. | 347/9 |
| 2008/0129770 | A1 * | 6/2008 | Mizugaki | 347/10 |
| 2008/0278534 | A1 * | 11/2008 | Kim et al. | 347/19 |
| 2009/0201326 | A1 * | 8/2009 | Komori et al. | 347/9 |
| 2010/0128080 | A1 * | 5/2010 | Ito | 347/19 |

FOREIGN PATENT DOCUMENTS

| | | |
|---|---|---|
| JP | 09-174883 | 7/1997 |
| JP | 2000-033697 | 2/2000 |
| JP | 2002-196127 | 7/2002 |
| JP | 2003-159787 | 6/2003 |

(Continued)

*Primary Examiner* — Shelby Fidler
(74) *Attorney, Agent, or Firm* — Harness, Dickey & Pierce, P.L.C.

(57) ABSTRACT

A method for setting up a condition for a drive signal in a liquid ejection head that includes a plurality of linearly-arranged nozzles and driving elements provided for each of the nozzles, includes: calculating an average value or a median value of ejection rates for each nozzle relating to a supply of the drive signal under a plurality of conditions; classifying the plurality of nozzles into a plurality of groups based on the average value or the median value of the ejection rates; calculating a proper condition for the drive signal corresponding to each group based on a statistical value of the ejection rate relating to the group; and selecting one proper condition among proper conditions corresponding to the groups so as to set the selected proper condition for each nozzle.

7 Claims, 16 Drawing Sheets

FOREIGN PATENT DOCUMENTS

| | | | |
|---|---|---|---|
| JP | 2003-320291 | | 11/2003 |
| JP | 2005-193104 | | 7/2005 |
| JP | 2007-229958 | | 9/2007 |
| JP | 2008-194644 | | 8/2008 |
| JP | 2008-197513 | | 8/2008 |
| JP | 2008-197514 | | 8/2008 |
| JP | 2008276086 | A * | 11/2008 |

* cited by examiner

METHOD FOR SETTING UP DRIVE SIGNAL

CROSS-REFERENCE TO RELATED APPLICATION

This application is based on and claims priority from Japanese Patent Application No. 2008-033238, filed on Feb. 14, 2008, the contents of which are incorporated herein by reference.

BACKGROUND

1. Technical Field

The present invention relates to a method for setting up a drive signal in a liquid ejection head.

2. Related Art

In recent years, it has been proposed to employ a liquid ejection head with a plurality of small nozzles in the production of a thin film. A liquid including a functional material is ejected from predetermined nozzles onto a substrate and then fixed to form a thin film.

An example of such a thin film may include an emitting layer for a color filter or an organic electroluminescence panel, or metal wiring.

In a method disclosed in Japanese Unexamined Patent Application, First Publication No. 2003-159787, it is required that a liquid is ejected from a plurality of nozzles in a uniform amount (hereinafter, referred to as "ejection rate") with no variation for the production of a high quality thin film.

Variation in the ejection rate may cause variation in the amount of the liquid placed on the substrate, which may lower uniformity in the produced thin film.

In a method using a liquid ejection head, for example, a method for manufacturing a color filter using a liquid ejection head, variation in the ejection rate may cause variation in the amount (i.e., the total ejection rate) of the liquid placed on the substrate. As a result, striped density unevenness appears in an obtained color filter.

Such striped density unevenness is easy to visually recognize and thus impairs the quality of the image displayed on the color filter.

A substrate with patterned, sectioned areas is used in the production of a color filter. Such a substrate includes areas between adjacent sectioned areas where no liquid is placed.

In this case, not all the nozzles are used at the same time.

Different models of the color filter may have differently-pitched sectioned areas. Accordingly, ejection patterns should be adjusted in the model.

A large substrate may be scanned several times for placing the liquid, which requires different nozzles for each scanning event.

Such a difference in frequency of use of the nozzles may cause variation in the ejection rate.

Variations in the ejection rate often occur even in a single nozzle if the same drive signal is used for ejection operation. This is because the ejection rate varies in a single nozzle due to differences in the patterns on the substrate or differences in relative positions of the substrate and the liquid ejection head.

In order to address this problem, a technique has been proposed to compensate for the variation in the ejection rate among the nozzles by setting up and supplying drive signals to the nozzles (i.e., drive elements) under several conditions in accordance with gradual changes in the ejection rate. Such a technique is disclosed in, for example, Japanese Unexamined Patent Application, First Publication No. H9-174883.

However, the technique described above requires a determining of a variation in the ejection rate among the nozzles to appropriately set up the conditions (e.g., the voltage level) for the drive signals in order to compensate for (i.e., relatively correct) the variation.

Although it is ideal to set up the drive signals independently for each nozzle, the types (i.e., systems) of the drive signals that can be set up are limited due to a limited hardware configuration or due to limited controls.

Since distribution of the variation in the ejection rate is uneven among nozzle arrays and the heads, it is difficult to set up conditions for the drive signals for each nozzle appropriately in a single process.

SUMMARY

An advantage of some aspects of the invention is to provide a method for setting up a drive signal highly accurately in accordance with characteristics of nozzles in a liquid ejection head so that a liquid can be ejected uniformly even when the nozzles are used with different frequencies.

In order to address the problem described above, an aspect of the invention provide a method for setting up a condition for a drive signal in a liquid ejection head that includes a plurality of linearly-arranged nozzles and driving elements provided for each of the nozzles, the drive signal being supplied to the driving elements when a liquid is ejected from the nozzles to a receiving medium. The method includes: calculating an average value or a median value of ejection rates for each nozzle relating to a supply of the drive signal under a plurality of conditions (i.e., step A); classifying the plurality of nozzles into a plurality of groups based on the average value or the median value of the ejection rates (i.e., step B); calculating a proper condition for the drive signal corresponding to each group based on a statistical value of the ejection rate relating to the group (i.e., step C); and selecting one proper condition among proper conditions corresponding to the groups so as to set the selected proper condition for each nozzle (i.e., step D).

According to this aspect of the invention, the nozzles are classified into several groups based on the average value or the median value of the ejection rates for each nozzle relating to a supply of the drive signal under a plurality of conditions. Thereafter, graded proper conditions are determined (i.e., calculated) on a group basis from the distribution of the ejection rate and the proper conditions are selected for each nozzle. In this manner, the drive signal can be set up highly accurately in accordance with the characteristics of the nozzles so that a liquid can be ejected uniformly even when the nozzles are used with different frequencies.

It is preferable that, in the method of this aspect of the invention, in the selecting one proper condition among the proper conditions corresponding to the groups so as to set the selected proper condition for each nozzle, that is in the step D, one proper condition that corresponds to a group relating to the statistical value most close to the ejection rate of the nozzle be selected so as to set the selected proper condition for each nozzle.

According to this aspect of the invention, the drive signal can be set up more highly accurately in accordance with the characteristics of the nozzles.

It is preferable that, in the method of this aspect of the invention, each of the groups be configured by substantially an equal number of nozzles.

According to this aspect of the invention, the conditions can be set up for the drive signal on a group basis, each of the groups including substantially an equal number of nozzles.

Therefore, an excessive concentration of the nozzles which correspond to specific conditions can be prevented.

It is preferable that, in the method of this aspect of the invention, the statistical value of the ejection rate relating to the group be an average value of the ejection rates of the nozzles in the group.

It is preferable that, in the method of this aspect of the invention, the statistical value of the ejection rate relating to the group be a median value of the ejection rates of the nozzles in the group.

It is preferable that, in the method of this aspect of the invention, the condition for the drive signal be a voltage component of the drive signal.

DESCRIPTION OF EXEMPLARY EMBODIMENTS

Figure 1:
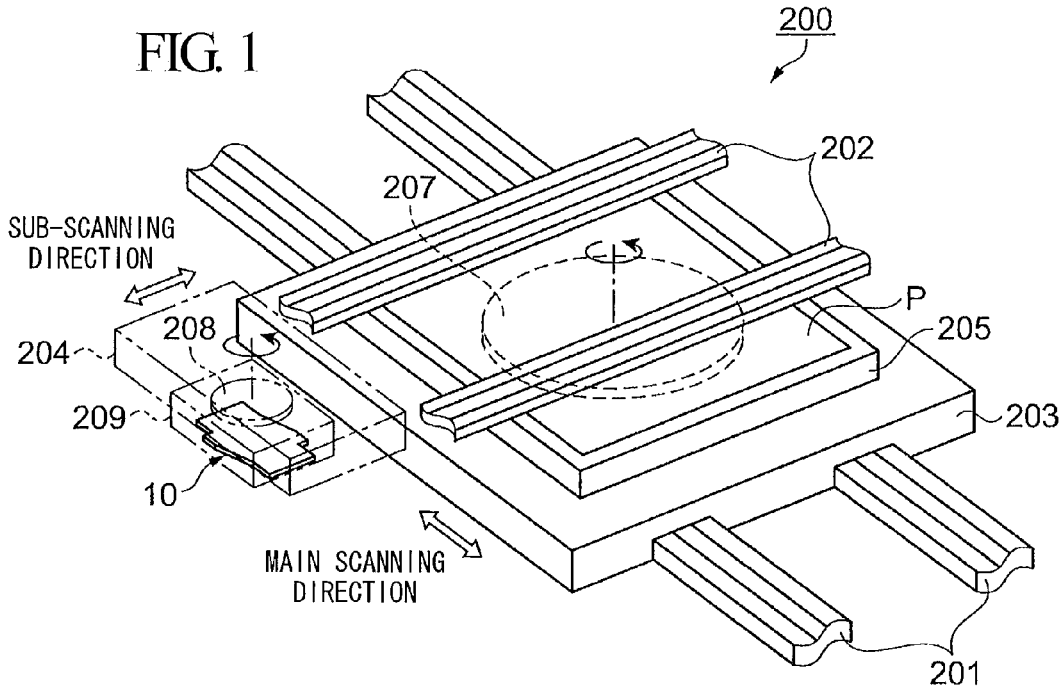
FIG. 1 is a perspective view showing the configuration of a main part of a liquid ejection device.

Referring now to the accompanying drawings, embodiments of the invention will be described in detail.

The embodiments described below are preferred examples of the invention and are therefore technically limited in many ways. The scope of the invention is not limited to those described unless otherwise stated in the following description.

In the drawings which will be referred to in the following description, the members or the parts are not to scale for ease of illustration.

Mechanical Configuration and Operation of Liquid Ejection Device

First, with reference to FIGS. 1 to 3, the mechanical configuration and operation of the liquid ejection device according to an embodiment of the invention will be described.

FIG. 1 is a perspective view showing the configuration of a main part of the liquid ejection device.

Figure 2:
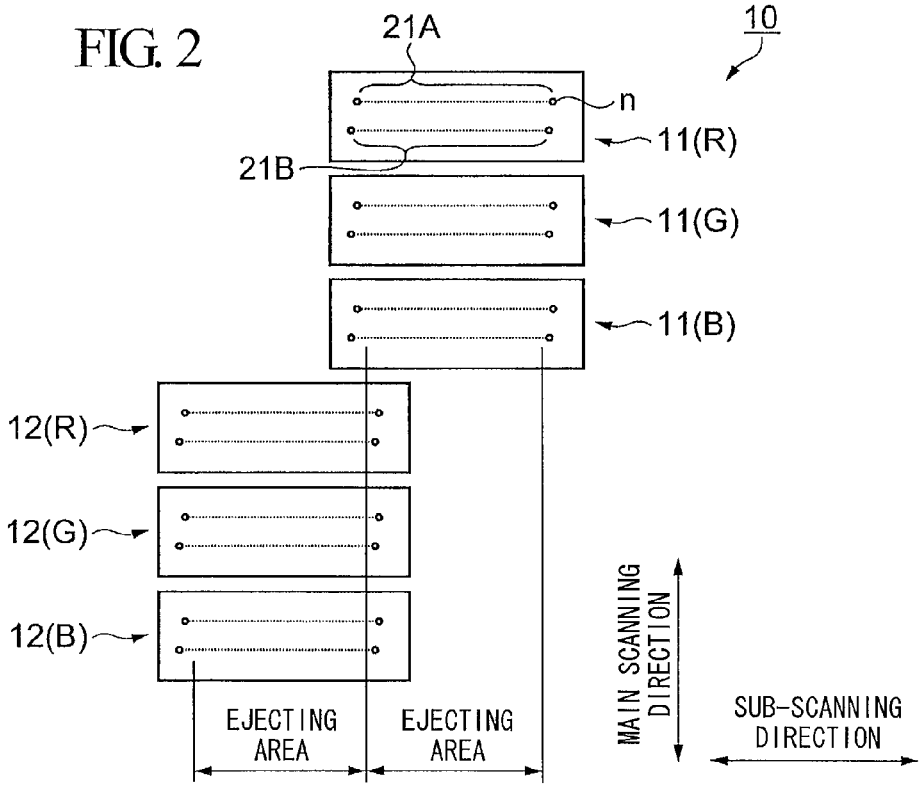
FIG. 2 is a plan view showing the configuration of heads in a head unit.

FIG. 2 is a plan view showing the configuration of heads in a head unit.

Figure 3:
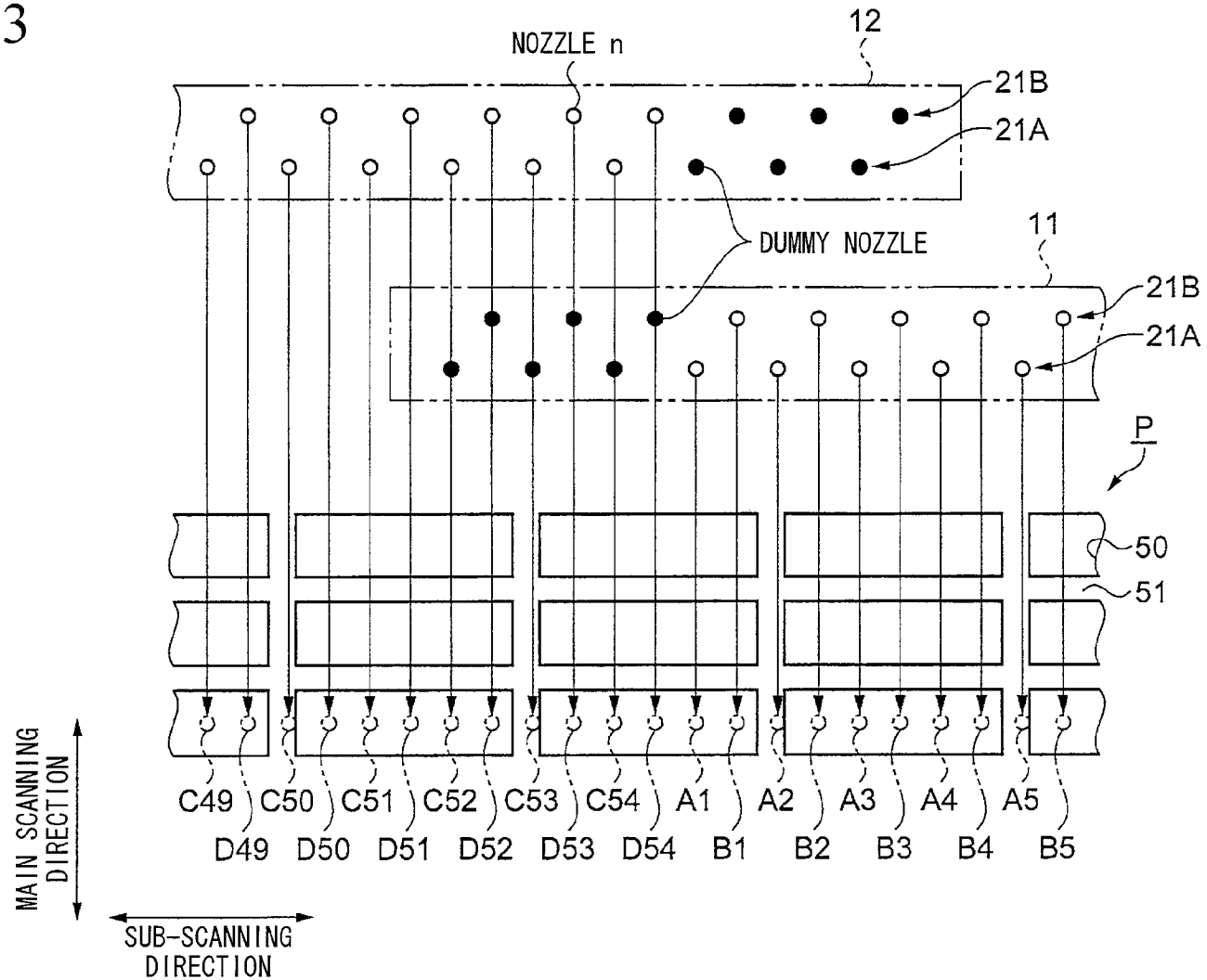
FIG. 3 is a plan view showing a positional relationship between scanning loci of the nozzles and a receiving medium.

FIG. 3 is a plan view showing a positional relationship between scanning loci of the nozzles and a receiving medium.

A liquid ejection device 200 shown in FIG. 1 includes a pair of linearly-arranged guide rails 201 and a main scanning carriage 203. The main scanning carriage 203 travels in a main scanning direction by means of an air slider and a linear motor (not shown) provided within the guide rail 201.

The liquid ejection device 200 also includes a pair of linearly-arranged guide rails 202 and a sub-scanning carriage 204. The guide rails 202 are disposed above the guide rails 201 perpendicular to the guide rails 201. The sub-scanning carriage 204 travels along a sub-scanning direction by means of an air slider and linear motor (not shown) provided within the guide rail 202.

The main scanning carriage 203 includes a stage 205 on which a substrate P as a receiving medium is placed.

The substrate P can be absorbed and fixed on the stage 205. The stage 205 aligns a reference axis in the substrate P along the main scanning direction and the sub-scanning direction accurately by means of a rotation mechanism 207.

The sub-scanning carriage 204 includes a carriage 209 suspending therefrom via a rotation mechanism 208.

Figure 4:
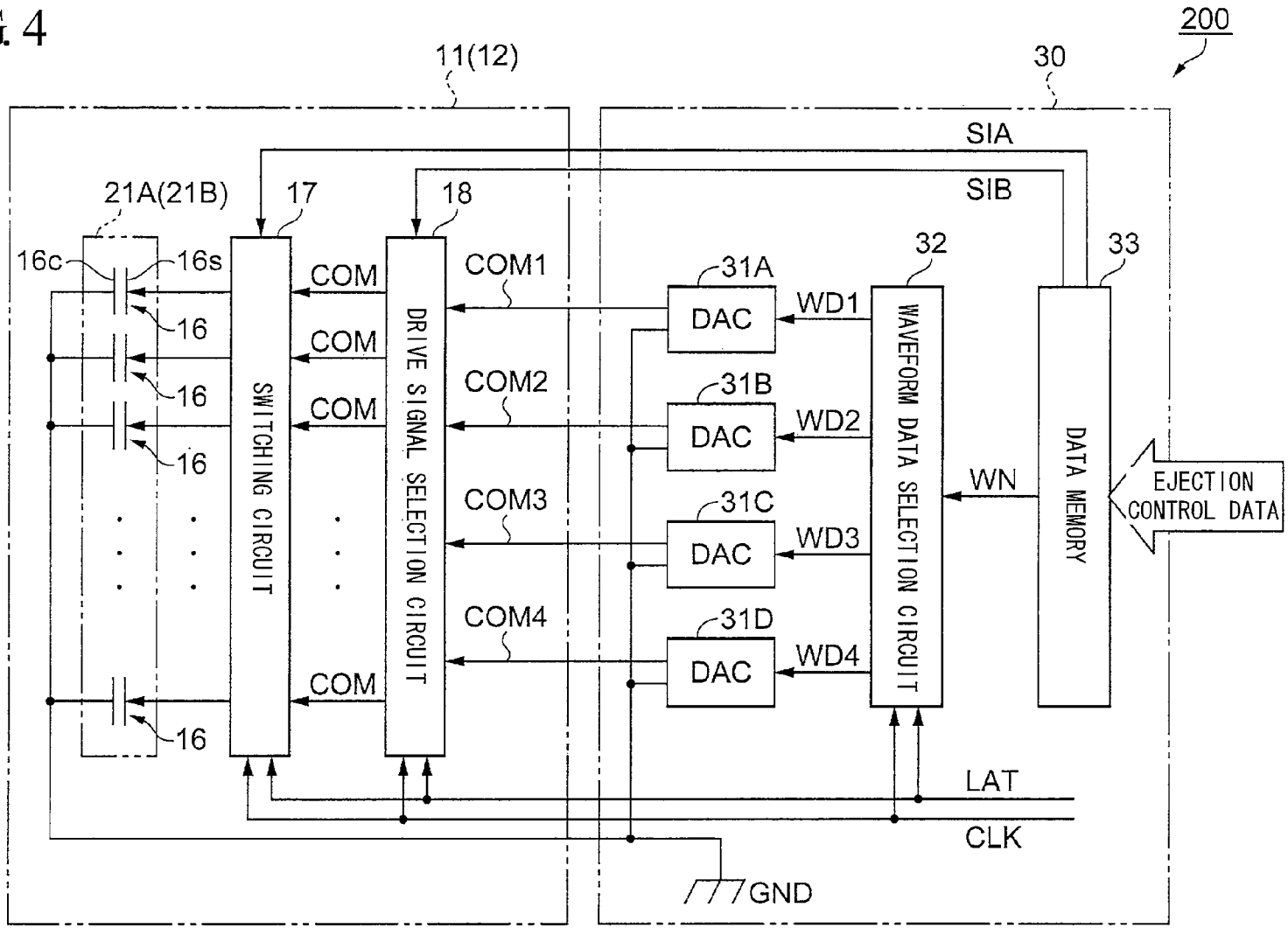
FIG. 4 is a diagram illustrating an electrical configuration of the liquid ejection device relating to the driving of the head.

The carriage 209 includes a head unit 10, a liquid supply mechanism (not shown), and a control circuit board 30 (see FIG. 4). The head unit 10 includes heads 11 and 12 (see FIG. 2) as liquid ejection heads. The liquid supply mechanism supplies the heads 11 and 12 with the liquid. The control circuit board 30 controls the driving of the heads 11 and 12.

As shown in FIG. 2, the head unit 10 includes the heads 11 and 12 which eject a liquid from nozzles n.

The head unit 10 according to this embodiment is used in production of a color filter for a display panel. Each of the heads 11 and 12 ejects a liquid corresponding to one of color elements of red (R), green (G), and blue (B).

The heads 11 and heads 12 are displaced from each other along the sub-scanning direction so as to mutually complement the ejecting areas.

A plurality of (60 in this embodiment) nozzles n of the heads 11 and 12 is linearly arranged at predetermined pitches (e.g., 180 dpi) to form nozzle arrays 21A and 21B.

The nozzles n in the nozzle arrays 21A and 21B are arranged along the sub-scanning direction. The nozzles n in the nozzle arrays 21A and 21B are arranged in a zigzag pattern (staggered pattern).

The heads 11 and 12 each includes a fluid chamber (hereinafter, referred to as "cavity") which is in fluid communication with each nozzle n. Each cavity includes a piezoelectric element 16 (see FIG. 4) as a driving element for driving a movable wall so as to change the capacity of the cavity.

Electrical signals (hereinafter, referred to as "drive signals") are supplied to the piezoelectric element 16 to control the hydraulic pressure in the cavity so as to eject droplets (i.e., the liquid) from the nozzles n.

Here, the operation of the liquid ejection device 200 will be illustrated with reference to the operation for production of a color filter.

When the heads 11 and 12 travel in the main scanning direction with respect to the substrate P, the nozzles n draw scanning loci at predetermined continuous pitches (e.g., 360 dpi) with respect to the substrate P as shown in FIG. 3.

Several (three in this embodiment) nozzles n near the edge of the nozzle arrays 21A and 21B are dummy nozzles (filled in the drawing) which are not used based on specificity of characteristics of the dummy nozzles. The scanning area relating to the dummy nozzles of the heads 11 is complemented by the nozzles n of the heads 12 and the scanning area relating to the dummy nozzles of the heads 12 are complemented by the nozzles n of the heads 11.

The substrate P used in production of the color filter includes banks 51 which define sectioned areas 50. The sectioned areas correspond to pixel areas. The banks 51 are formed in advance of, for example, a photosensitive resin.

For the substrate P, scanning loci of some nozzles n relate to the sectioned areas 50 and scanning loci of the other nozzles relate to no sectioned areas 50. The liquid is ejected and placed onto the sectioned areas 50 by the nozzles n of which scanning loci relate to the sectioned areas 50.

The reference numerals A1 to A5, B1 to B5, C49 to C54, and D49 to D54 in FIG. 3 denote nozzle numbers of the nozzles in the nozzle array 21A of the head 11, the nozzle array 21B of the head 11, the nozzle array 21A of the head 12 and the nozzle array 21B of the head 12.

The nozzle numbers are serial numbers showing a sequence of the nozzles n in a direction in which the nozzle arrays 21A and 21B are arranged. In this embodiment, nozzle numbers 1 to 54 are used to denote the nozzles in a nozzle array except for the dummy nozzles.

In FIG. 3, the nozzles n with nozzle numbers of D53, C54, D54, A1, and B1 eject the liquid to the same sectioned area 50 in a suitable period during scanning.

The nozzles n with nozzle numbers C50, C53, A2, and A5 do not eject the liquid in all period during scanning since their scanning loci are on the banks 51.

The nozzles n are controlled to eject or not to eject the liquid by switching supply and no-supply of the drive signals to the piezoelectric element 16 corresponding to the nozzle (which will be described in detail later).

The configuration of the liquid ejection device is not limited to those described above.

For example, the array direction of the nozzle arrays 21A and 21B may be inclined with respect to the sub-scanning direction so that the pitches between the scanning loci of the nozzles n become narrower than the pitches between the nozzles n in the nozzle arrays 21A and 21B.

In addition, the number and the arrangement configuration of the heads 11 and 12 in the head unit 10 can be appropriately changed.

In addition, the heads 11 and 12 may be thermally driven using a heating element provided in the cavity.

Electrical Configuration and Operation of Liquid Ejection Device

Next, with reference to FIGS. 4 and 5, the electric configuration and operation of the liquid ejection device according to the embodiment of the invention will be described.

FIG. 4 is a diagram illustrating an electrical configuration of the liquid ejection device relating to the driving of the heads.

Figure 5:
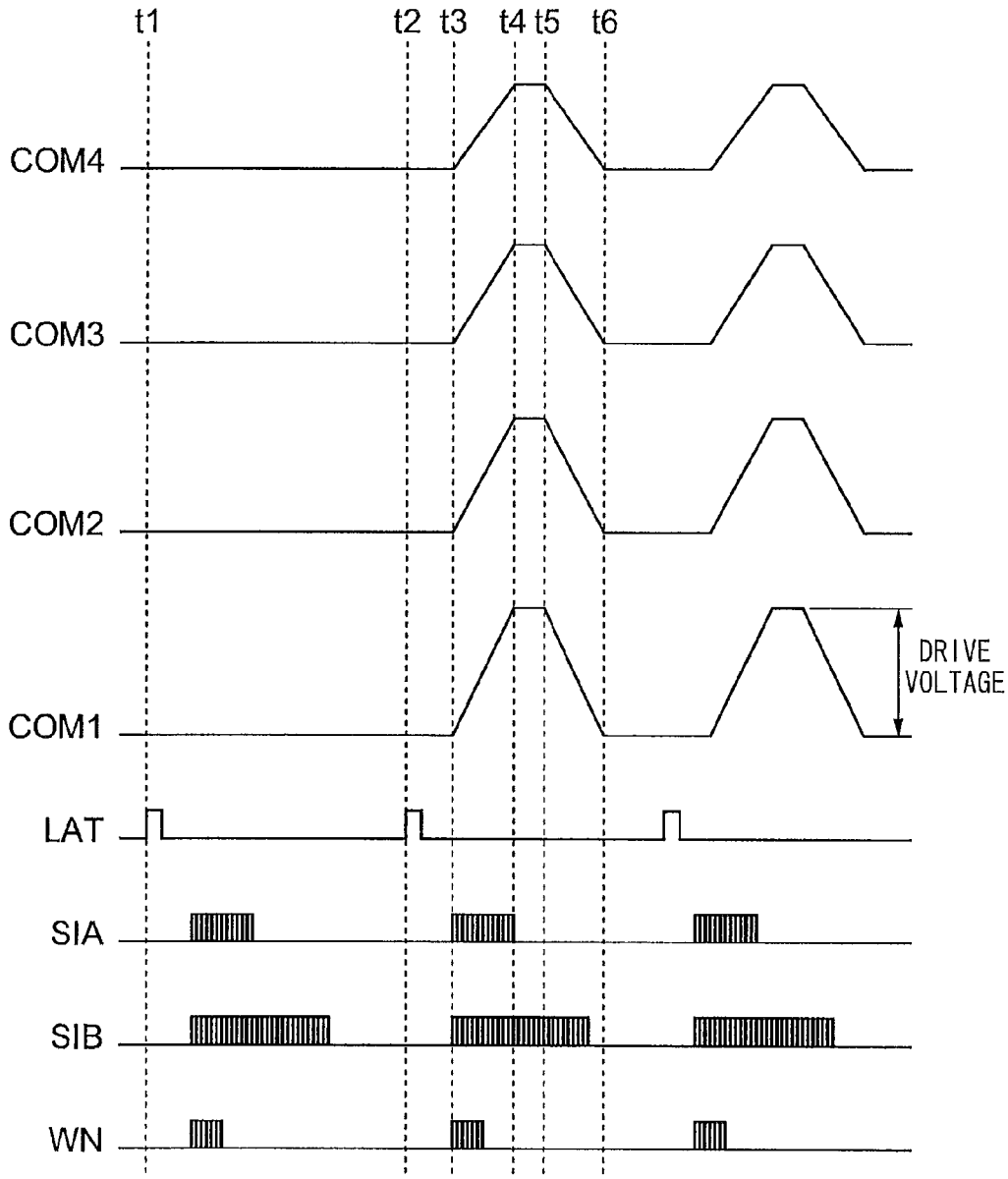
FIG. 5 is a timing chart of drive signals and control signals.

FIG. 5 is a timing chart of drive signals and control signals.

As shown in FIG. 4, the head 11 (12) includes a piezoelectric element 16, a switching circuit 17, and a drive signal selection circuit 18. The piezoelectric element 16 is provided for each nozzle n (see FIG. 2) of the nozzle array 21A (21B). The switching circuit 17 switches between supply and non-supply of the drive signal (COM) to each piezoelectric element 16. The drive signal selection circuit 18 is for selecting supply lines (hereinafter, referred to as "COM lines" (COM1 to COM4)) for the drive signals to be supplied to each piezoelectric element 16.

The head 11 (12) is electrically connected to a control circuit board 30.

The control circuit board 30 includes D/A converters (DAC) 31A to 31D, a waveform data selection circuit 32, and a data memory 33. The D/A converters (DAC) 31A to 31D each generates independent drive signals (COM). The waveform data selection circuit 32 includes a memory for storing slew rate data (hereinafter, referred to as "waveform data" (WD1 to WD4)) of the drive signals (COM) generated by the D/A converters 31A to 31D. The data memory 33 stores ejection control data received from the outside.

The drive signals generated by the D/A converters 31A to 31D are output to the COM lines (COM1 to COM4) in the control circuit board 30.

In the nozzle array 21A (21B), one electrode 16*c* of the piezoelectric element 16 is connected to ground lines (GND) of the D/A converters 31A to 31D.

The other electrode (hereinafter, referred to as "segment electrode") 16*s* of the piezoelectric element 16 is connected to the COM lines (COM1 to COM4) via the switching circuit 17 and the drive signal selection circuit 18.

Clock signals (CLK) and latch signals (LAT) corresponding to each ejection timing are input to the switching circuit 17, the drive signal selection circuit 18, and the waveform data selection circuit 32.

Ejection data (SIA), drive signal select data (SIB), and waveform number data (WN) are stored in the data memory 33 for each ejection timing which is periodically set up in accordance with the scanning position of the head 11 (12).

The ejection data (SIA) defines switching supply and no-supply (ON/OFF) of the drive signals (COM) to the piezoelectric elements 16. The drive signal select data (SIB) defines the COM line (COM1 to COM4) corresponding to each piezoelectric element 16. The waveform number data (WN) defines the type of the waveform data (WD1 to WD4) input to the D/A converters 31A to 31D.

In this embodiment, the ejection data (SIA) is formed by 1 bit for each nozzle (0 and 1), the drive signal select data (SIB) is formed by 2 bits for each nozzle (0, 1, 2, and 3), and the waveform number data (WN) is formed by 7 bits for each D/A converter (0 to 127).

These data structures can be appropriately changed.

In the configuration described above, driving related to the ejection timing is controlled in the following manner.

In the period between timings t1 and t2 shown in FIG. 5, the ejection data (SIA), the drive signal select data (SIB), and the waveform number data (WN) are converted into serial signals and are then transmitted to the switching circuit 17, the drive signal selection circuit 18, and the waveform data selection circuit 32.

Then, the data is latched at the timing t2 such that the segment electrode 16*s* of each piezoelectric element 16 relating to the ejecting (ON) is connected to the COM line (COM1 to COM4) specified by the drive signal select data (SIB).

For example, when the drive signal select data (SIB) is 0, 1, 2, and 3, the segment electrode 16*s* of the corresponding piezoelectric element 16 is connected to the COM1, COM2, COM3, and COM4.

The waveform data (WD1 to WD4) of the drive signal for generation of the D/A converters 31A to 31D will be set up.

In the periods from t3 to t4, from t4 to t5, and from t5 to t6, the drive signals (COM) are generated in accordance with the waveform data set up at the timing t2 in a series of steps of potential rise, potential keep, and potential drop.

Then, the generated drive signals are supplied to the piezoelectric elements 16 connected to the COM1 to COM4 so as to control the capacity (i.e., pressure) of the cavity which is in communication with the nozzle.

The potential rise component in the period from t3 to t4 causes the cavity to inflate so as to draw the liquid into the nozzle.

The potential drop component in the period from t5 to t6 causes the cavity to deflate so as to push and eject the liquid out of the nozzle.

The time component and the voltage component relating to the potential rise, potential keep, and potential drop in the drive signals (COM) depend closely on the ejection rate of the liquid that is ejected from the nozzle caused by supplying the voltage to the piezoelectric element 16.

Especially in a piezoelectric head, since the ejection rate shows excellent linearity with respect to the change in the voltage component, the voltage difference in the period from t3 to t6 can be defined as a drive voltage Vh, which can be used as a condition for the control of the ejection rate.

That is, the drive voltage Vh corresponds to the "condition for the drive signal" in the invention.

The drive signal (COM) to be generated is not limited to a simple trapezoidal wave as shown in this embodiment. Any conventionally known waveforms can be used for the drive signal (COM).

Alternatively, the pulse width (i.e., the time component) of the drive signal may be used as a condition for the control of the ejection rate in a case where a different drive system (e.g., a thermal system) is employed.

In this embodiment, several types of waveform data with gradually different drive voltages Vh are prepared and independent waveform data (WD1 to WD4) is input to the D/A converters 31A to 31D. In this manner, the drive signals (COM) with different drive voltages Vh can be output to each of the COM lines (COM1 to COM4).

The number of types of waveform data to be prepared is 128 which correspond to the amount of information (i.e., 7 bits) of the waveform number data (WN). Each of the types of the waveform data is made to correspond to the drive voltage Vh on a 0.1V basis.

In this manner, the liquid ejection device 200 according to this embodiment can eject the liquid at a proper ejection rate when the drive signal select data (SIB) and the waveform number data (WN) are appropriately set up. The drive signal select data (SIB) defines the correspondence relationship between the piezoelectric elements 16 (i.e., the nozzles) and the COM lines (COM1 to COM4). The waveform number data (WN) defines the correspondence relationship between the COM lines (COM1 to COM4) and the types of drive signals (i.e., the drive voltage Vh).

In other words, it is important for the control of the ejection rate to appropriately set up the drive signals for each nozzle which are defined based on the relationship between the drive signal select data (SIB) and the waveform number data (WN).

In the liquid ejection device 200 according to this embodiment, the drive signal select data (SIB) and the waveform number data (WN) can be updated for each ejecting event. Accordingly, the drive signals can be set up precisely corresponding to changes in the ejection data (SIA).

Method for Setting Up Drive Signals

Next, with reference to FIGS. 4 and 6 to 9, a method for setting up a proper condition (i.e., drive voltage Vh) for the drive signals for each nozzle will be described.

Figure 6:
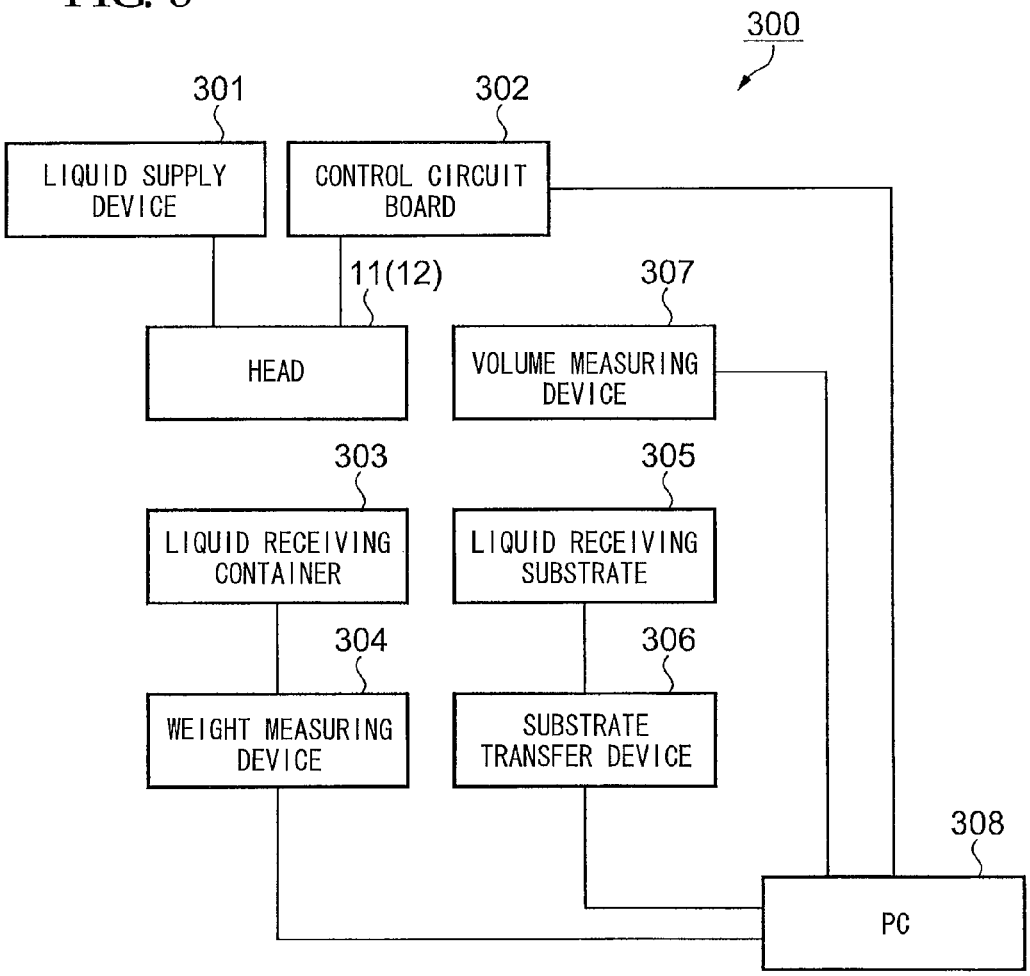
FIG. 6 is a block diagram showing a configuration of a device for setting up the drive signal.

FIG. 6 is a block diagram showing a configuration of a device for setting up the drive signal.

Figure 7:
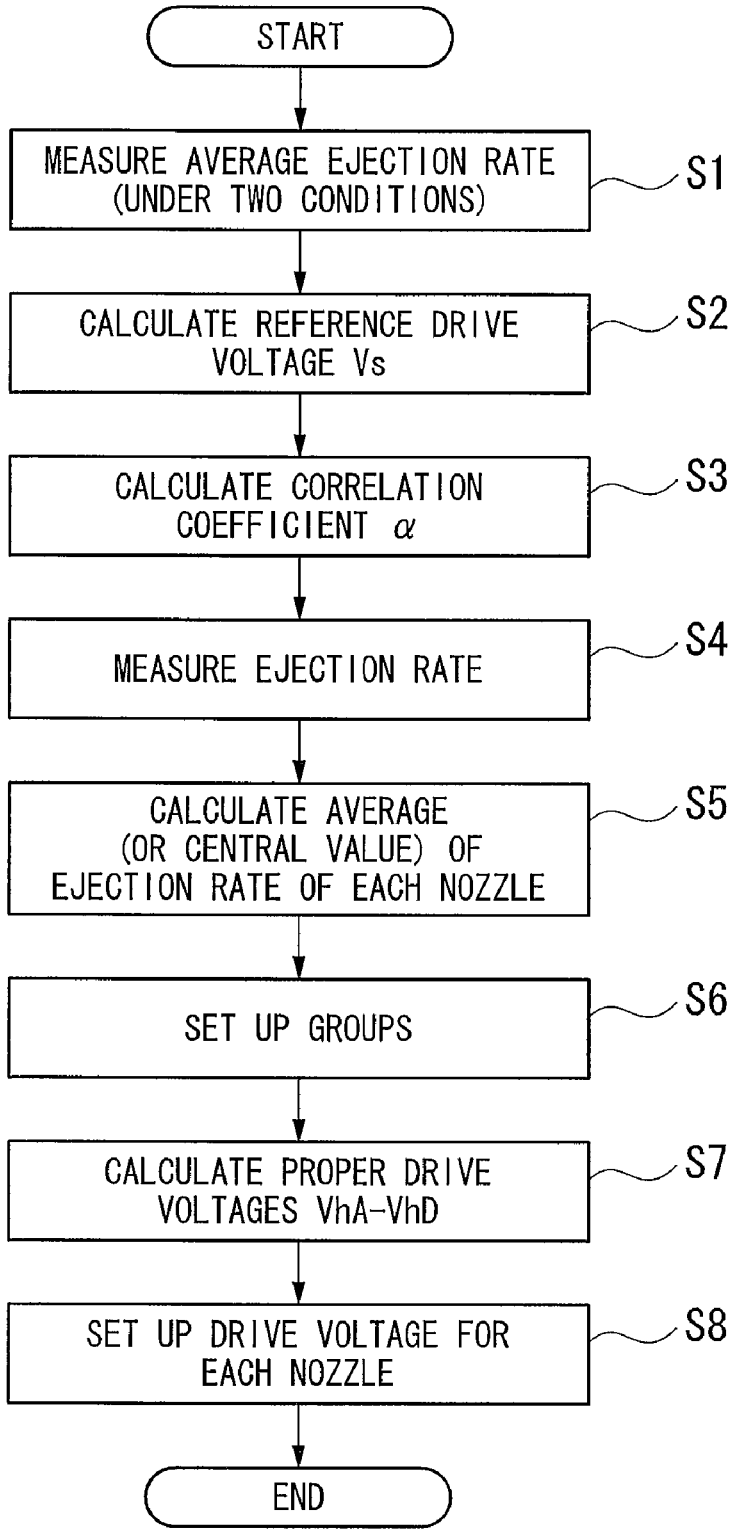
FIG. 7 is a flow chart showing process flow for setting up the drive signal.

FIG. 7 is a flow chart showing a process flow for setting up the drive signal.

Figure 8:
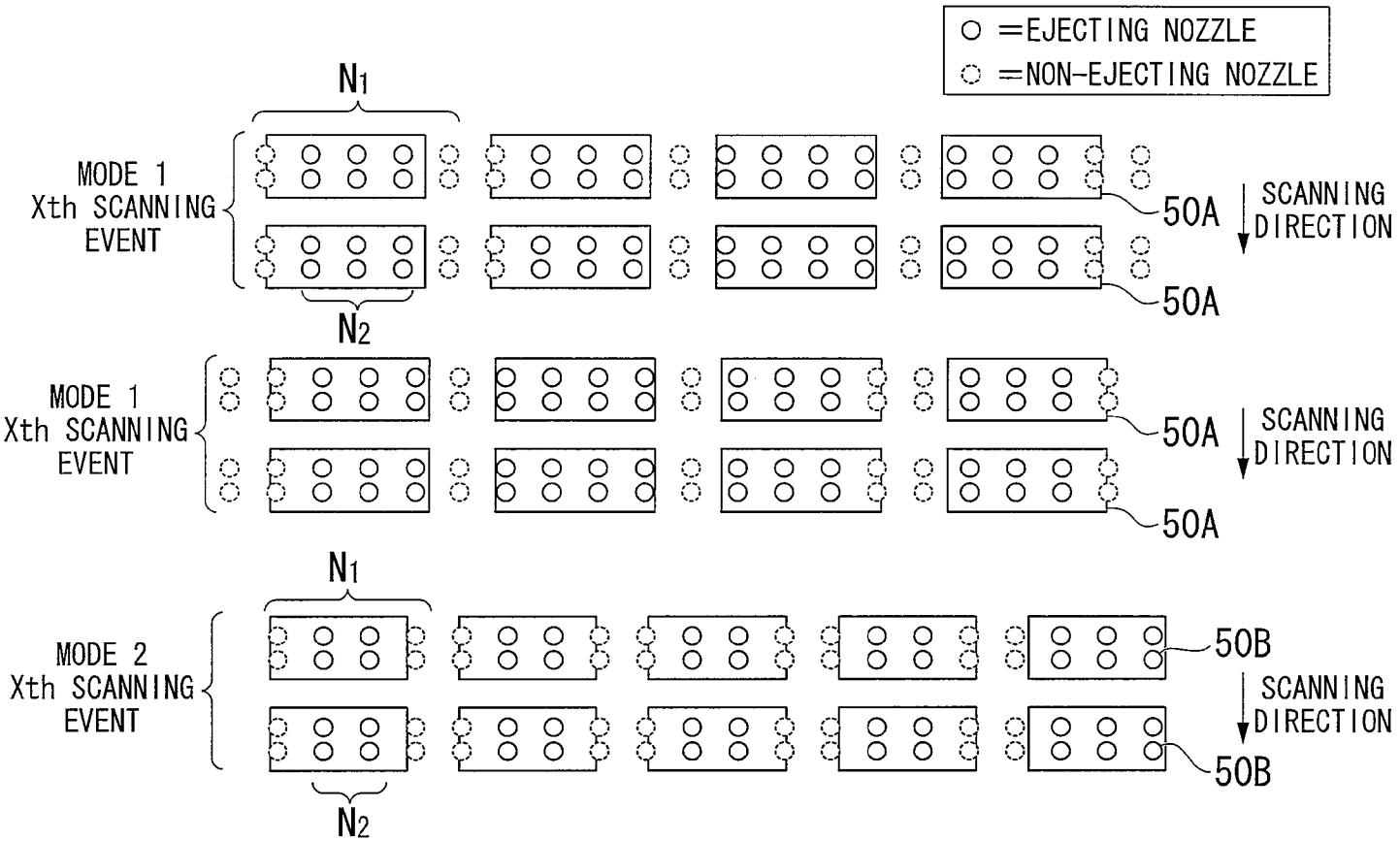
FIG. 8 is a plan view showing a positional relationship between nozzles and sectioned areas relating to the scanning of the head.

FIG. 8 is a plan view showing a positional relationship between nozzles and sectioned areas relating to the scanning of the head.

Figure 9:
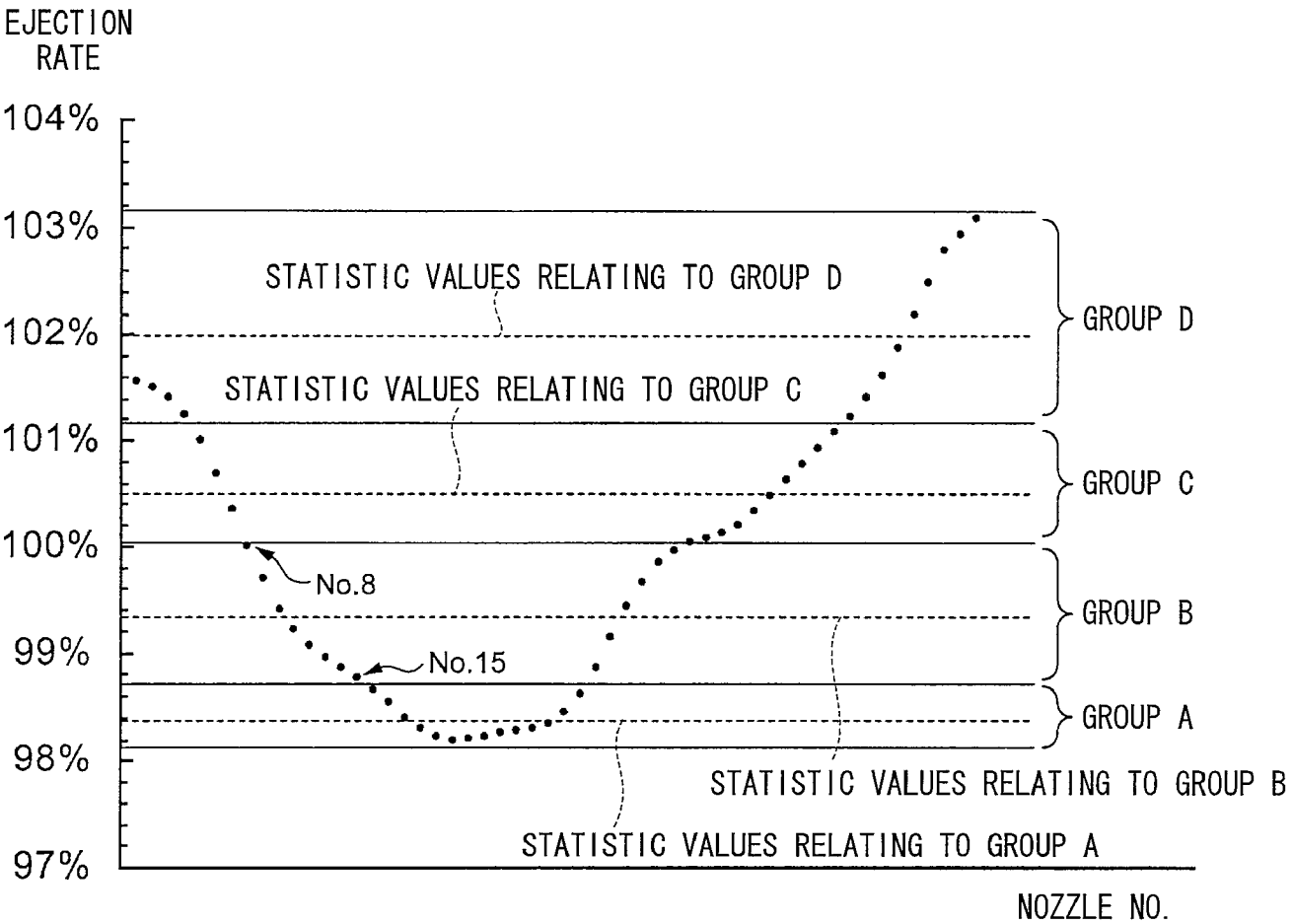
FIG. 9 is a diagram illustrating distribution of an ejection rate for each nozzle and group classification.

FIG. 9 is a diagram showing the distribution of an ejection rate for each nozzle and a group classification.

In FIG. 6, a setup device 300 for setting up the drive signals includes a liquid supply device 301 for supplying the liquid to the head 11 (12) and a control circuit board 302 for driving the head 11.

The setup device 300 also includes a liquid receiving container 303 for receiving and containing the liquid ejected from the head 11 and a weight measuring device 304 for measuring the weight of the liquid receiving container 303.

The setup device 300 also includes a liquid receiving substrate 305 which receives the liquid ejected from the head 11, a substrate transfer device 306 for transferring the liquid receiving substrate 305 along a direction that is parallel to the surface of the substrate, and a volume measuring device 307 for measuring the volume of the liquid placed on the liquid receiving substrate 305.

The setup device 300 also includes a personal computer (PC) 308. The personal computer 308 controls the driving of the head 11 via the control circuit board 302, controls the driving of the substrate transfer device 306, controls the measuring operation of the weight measuring device 304 and the volume measuring device 307, and calculates based on the measuring result.

The control circuit board 302 has the same configuration as that of the control circuit board 30 (see FIG. 4).

The liquid receiving container 303 can be configured of any materials as long as they are not eroded by the liquid. Preferably, the liquid receiving container 303 includes a porous member such as a sponge at an opening thereof to prevent volatilization of the liquid.

A common electronic balance can be used for the weight measuring device 304.

A three-dimensional geometry measurement apparatus using white-light interferometry can be used as the volume measuring device 307.

In this manner, the setup device 300 can measure the ejection rate in terms of weight and volume using two measuring devices, i.e., the weight measuring device 304 and the volume measuring device 307.

The weight measuring device 304 is suitable for measuring the average ejection rate of the entire nozzle array highly precisely at high speed.

The volume measuring device 307 is suitable for measuring the ejection rate for each nozzle.

In a state in which the head 11 is connected to the setup device 300, the average ejection rate of all the nozzles (except for the dummy nozzles) in the nozzle array is first determined (step S1 of FIG. 7).

In particular, a unit number (e.g., 100,000 times) of ejecting events is conducted at each nozzle, and the total weight of the ejected liquid is measured by the weight measuring device 304. Then, the measured result is divided to obtain the average ejection rate.

The measurement is conducted under two different conditions of the drive voltage Vh (for example, 20V and 30V).

Next, the drive voltage Vh and the average ejection rate obtained under the two different measuring conditions are linearly interpolated to calculate a reference drive voltage Vs used for obtaining the average ejection rate at a reference ejection rate (i.e., a designed value according to the specification) (step S2 of FIG. 7).

The rate of change of the average ejection rate with respect to the drive voltage Vh is calculated as a correlation coefficient $\alpha$ for the correction of the ejection rate using the drive voltage Vh (step S3 of FIG. 7).

Next, the drive signals under a plurality of conditions are supplied to all the piezoelectric elements of the nozzle array to cause the liquid to be ejected onto the liquid receiving substrate 305. The ejection rate is measured (step S4 of FIG. 7).

Since the surface of the liquid receiving substrate 305 is liquid-repellent, the liquid ejected from the nozzles forms independent, hemispherical droplets on the substrate.

The three-dimensional geometry of the droplet is measured by the volume measuring device 307. The measured data is analyzed by the personal computer 308 to obtain the ejection rate.

Since the ejection rate for each ejecting event is significantly small, the liquid is ejected several times (e.g., 3 times) by each nozzle at a single position in order to improve accuracy in the measurement of volume (i.e., measurement of the ejection rate) of the droplet.

Here, the drive signals under a plurality of conditions means a plurality of drive signals under a plurality of conditions that are different in accordance with real ejection patterns when a liquid is ejected from the nozzles to the receiving medium.

For example, as shown in FIG. 8, when the liquid is ejected from the nozzles arranged in one direction toward a plurality of sectioned areas 50A (model 1) that are provided on the substrate so as to be divided at a predetermined distance, some nozzles relate to the sectioned areas 50A, and others do not. The liquid is ejected and placed onto the sectioned areas 50A by the nozzles relating to the sectioned areas 50A.

In FIG. 8, the nozzles relating to the sectioned areas are illustrated by solid lines as "ejecting nozzles", and the nozzles not relating to the sectioned areas are illustrated by dashed lines as "non-ejecting nozzles."

In this case, the ejecting nozzles and non-ejecting nozzles are switched for each scanning event, and all the nozzles are not used at the same time (see Xth and Yth scanning events). In addition, also in the case where the liquid is placed to a sectioned area 50B in a different model (model 2), the ejecting nozzles and non-ejecting nozzles are switched for each scanning event.

Therefore, even if an identical model is used when a liquid is ejected from the nozzles to the receiving medium, the drive signals that are different in accordance with real ejection patterns are used.

In addition, if the pitches of the sectioned areas are different in each model, the drive signals are required so that ejection patterns are different in each model.

Furthermore, in the case where a large substrate is scanned several times for placing the liquid, the drive signals are required so that the nozzles used for each scanning event are different.

In this embodiment, by supplying the drive signals under the conditions that are different from each other described above, the ejection rate of each nozzle is measured.

Next, the average value or a median value of the ejection rates of each nozzle is determined based on the measurement data of the ejection rate of the nozzles (step S5 of FIG. 7).

That is, step S5 constitutes the step A of the invention.

the number of the data pieces n used for calculating the average value or the median value of the ejection rates of each nozzle with respect to the number of drive signals N under the conditions that are different in accordance with real ejection patterns when a liquid is ejected from the above-described nozzles to the receiving medium may be set to $n \leqq N$, where N and n are integers and greater than or equal to 2.

In this embodiment, the case where the average value of the ejection rates of each nozzle is calculated is described as an example. The case where the median value of the ejection rate of each nozzle is similarly adopted in steps described below.

The ejection rate based on the average value of the ejection rates of each nozzle calculated at step S5 is shown as a spatial distribution along the direction in which the nozzle array is arranged as shown in FIG. 9 (in FIG. 9, the ejection rate is represented as the relative ratio with respect to the reference ejection rate q0).

As shown in FIG. 9, in the head according to this embodiment, the ejection rates become higher toward the ends of the nozzle array and lower toward the center of the nozzle array.

Next, based on the average value of the ejection rates of each nozzle calculated at step S5, the nozzles are grouped (step S6 of FIG. 7).

That is, step S6 constitutes step B of the invention.

In this embodiment, the nozzles are classified into several groups in accordance with the order of the calculated ejection rates of the nozzles. That is, nozzles with higher ejection rates are classified as a high-order group. Also, nozzles with lower ejection rates are classified as a low-order group.

Specifically, groups A, B, C, and D are classified such that the group A is constituted of the 14 nozzles whose ejection rates are lowest, the group B is constituted of the 14 nozzles whose ejection rates are higher than that of the lowest 14 nozzles of the group A, the group C is constituted of the 13 nozzles whose ejection rates are higher than that of the 14 nozzles of the group B, and the group D is constituted of the 13 nozzles whose ejection rates are higher than that of the 13 nozzles of the group C. That is, the ejection rates of the 13 nozzles of the group D are highest.

Next, proper drive voltages Vh (hereinafter, referred to as "proper drive voltages VhA, VhB, VhC, and VhD") corresponding to the groups A to D are calculated (step S7 of FIG. 7).

Although the term "proper" can be freely defined, in this embodiment, the proper drive voltages VhA to VhD that cause statistical values of the ejection rates relating to groups A to D to correspond to the reference ejection rates q0 are calculated based on the average value of the ejection rates of each nozzle in step S5, the correlation coefficient α, and the reference drive voltage Vs.

That is, step S7 constitutes step C of the invention.

Here, the statistical values of the ejection rates relating to groups A to D refer to the numerical values obtained from the statistics of the ejection rates of the nozzles in each group. In this embodiment, the statistical values are the average values of the ejection rates of the nozzles in each group.

In this manner, gradual proper drive voltages VhA to VhD are obtained for the ejection of the liquid in an average proper amount (i.e., the reference ejection rate q0) from the nozzles of groups A to D.

Alternatively, step S7 may be performed using the median values of the ejection rates of the nozzles in each group as the statistical values.

The proper drive voltages VhA, VhB, VhC, and VhD in this embodiment are defined as relative ratios with respect to the reference drive voltage Vs, and are 101.8%, 100.7%, 99.4% and 97.9%, respectively.

Defining the proper drive voltages as the relative ratios has an advantageous effect in that, for example, if the ejection rates change uniformly due to change in the liquid viscosity, the average ejection rate for the entire nozzle array can be measured to re-set the reference drive voltage Vs.

Next, one of the proper drive voltages VhA, VhB, VhC, and VhD is selected and set up for each nozzle as the drive voltage Vh to correspond with each nozzle (step S8 of FIG. 7).

That is, step S8 constitutes step D of the invention.

The proper drive voltage VhA, VhB, VhC, and VhD may correspond with the four COM lines (COM1 to COM4 (see FIG. 4)) respectively in the control of the driving.

Alternatively, the proper drive voltage Vh to correspond with each nozzle may be collectively set up on a group basis.

However, groups with a relatively wide distribution range of the ejection rate like groups B and D may include nozzles with an ejection rate greatly departing from the statistical value. Accordingly, it is not always preferable to set up the proper drive voltage for such nozzles based on the statistical value of the group.

In this embodiment, one of the four proper drive voltages that is suited for the group relating to the statistical value most close to the ejection rate is selected and set up for each nozzle.

In this manner, the drive signal can be set up to be more highly accurately in accordance with the characteristics of the nozzles.

In the example shown in FIG. 9, the proper drive voltage VhA is set up for all the nozzles in group A.

For the nozzles in group B, the proper drive voltage VhB is set up for most of the nozzles, but the proper drive voltage VhC is set up, for example, for the nozzle of the nozzle number 8. Also, the proper drive voltage VhA is set up, for example, for the nozzle of the nozzle number 15.

In this manner, in the groups with a relatively wide distribution range of the ejection rate, the proper drive voltages corresponding to preceding and following groups may sometimes be set up for the nozzles near the border with the preceding and following groups.

As described above, according to the invention, the drive signal can be set up highly accurately in accordance with the characteristics of the nozzles so that a liquid can be ejected uniformly even when the nozzles are used with a different frequency by, based on the average value or the median value of the ejection rates of each nozzle, classifying the nozzles into several groups, determining (i.e., calculating) gradual proper conditions from the distribution of the ejection rates on a group basis, and selecting the proper conditions for each nozzle.

Figure 10A:
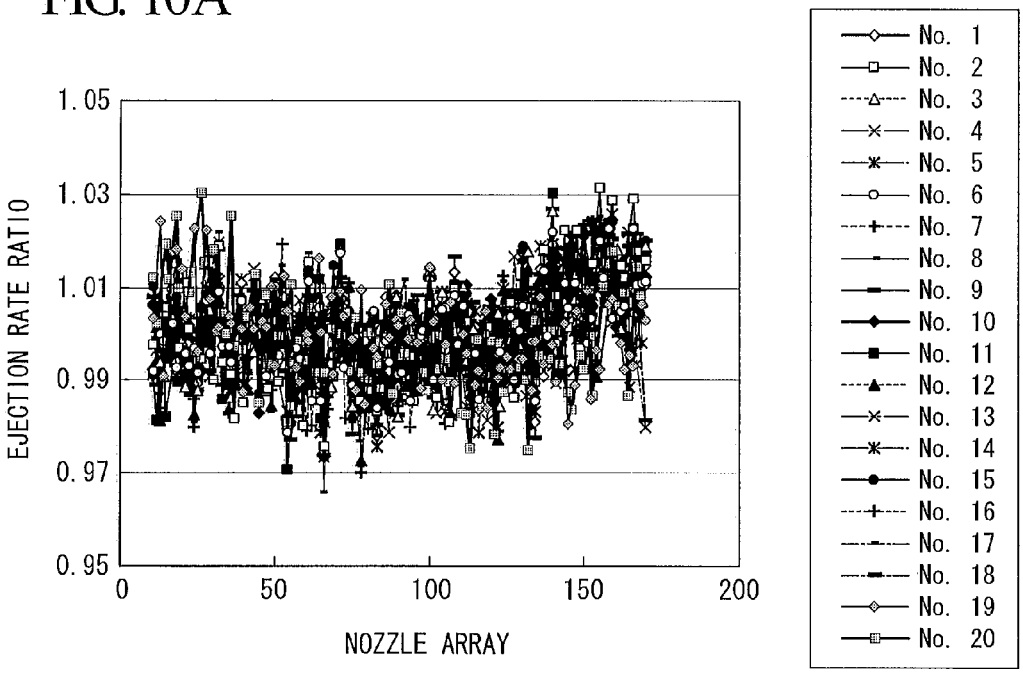
FIG. 10A is a diagram illustrating distribution of the ejection rates for each nozzle relating to a supply of the drive signal under a plurality of conditions.

Specifically, FIG. 10A is a diagram illustrating distribution of the ejection rates for each nozzle relating to a supply of the drive signals (No. 1 to 20) under the conditions that are different in accordance with real ejection patterns.

Figure 10B:
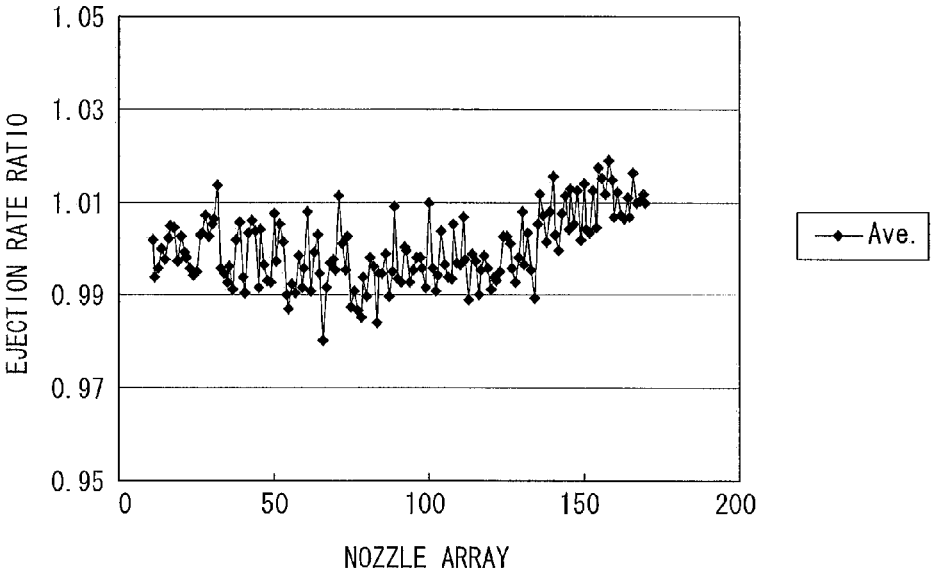
FIG. 10B is a diagram illustrating distribution of the average ejection rates for each nozzle.
Figure 11:
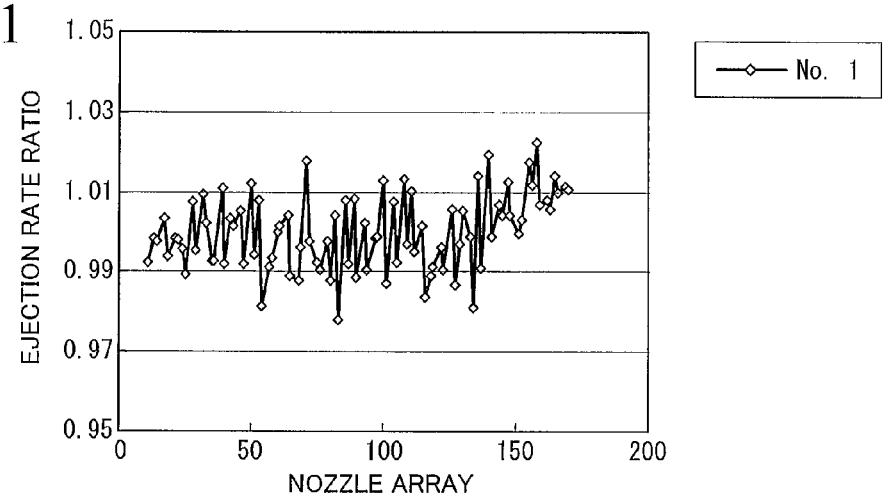
FIG. 11 is a diagram illustrating distribution of the ejection rates for each nozzle relating to a supply of a No. 1 drive signal.
Figure 12:
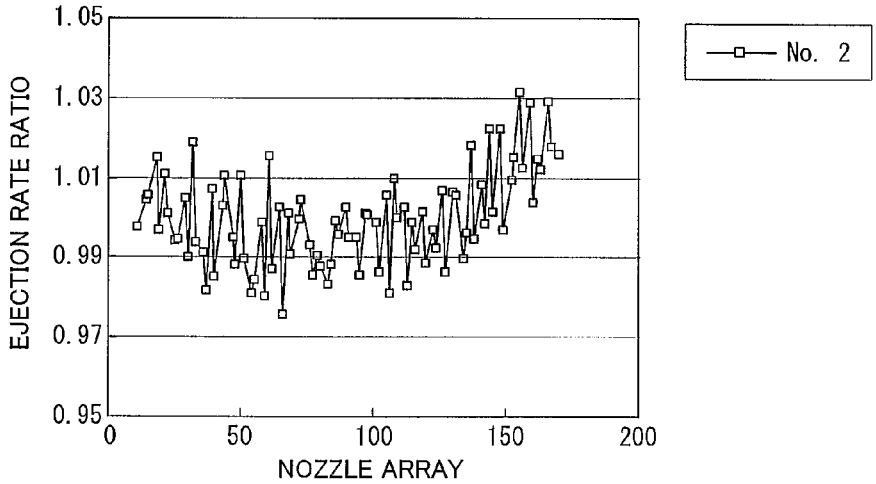
FIG. 12 is a diagram illustrating distribution of the ejection rates for each nozzle relating to a supply of a No. 2 drive signal.
Figure 13:
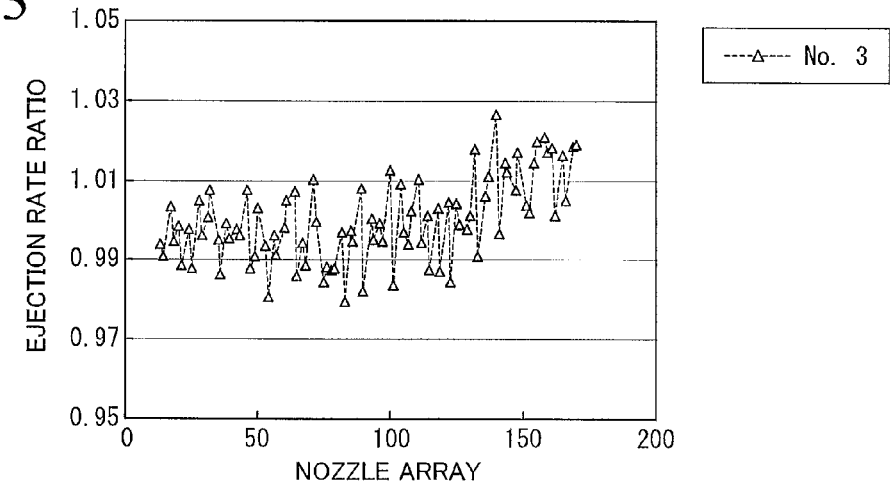
FIG. 13 is a diagram illustrating distribution of the ejection rates for each nozzle relating to a supply of a No. 3 drive signal.
Figure 14:
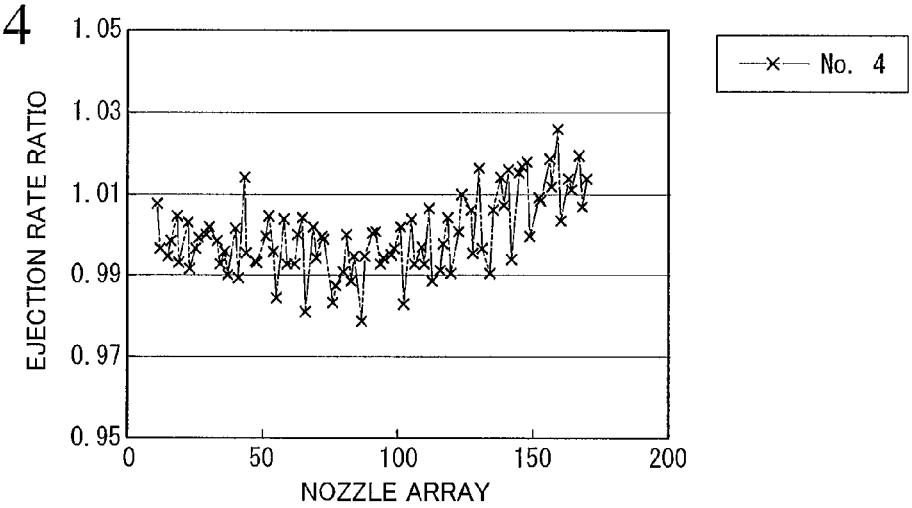
FIG. 14 is a diagram illustrating distribution of the ejection rates for each nozzle relating to a supply of a No. 4 drive signal.
Figure 15:
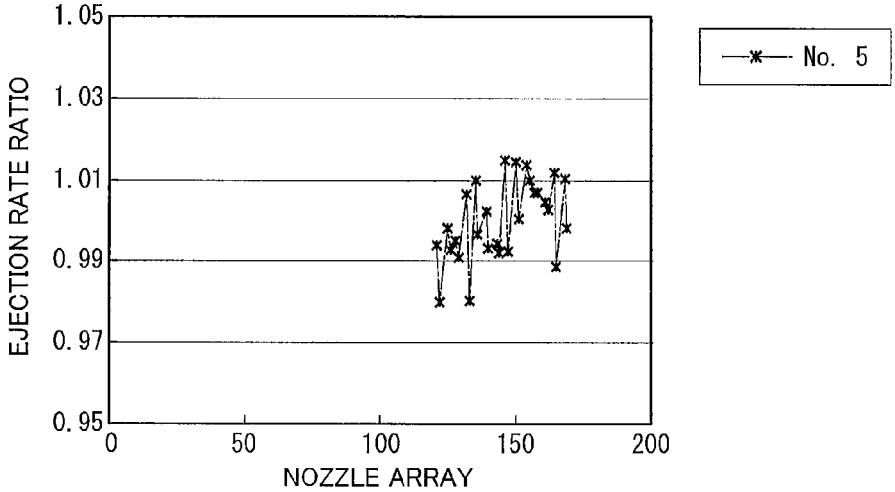
FIG. 15 is a diagram illustrating distribution of the ejection rates for each nozzle relating to a supply of a No. 5 drive signal.
Figure 16:
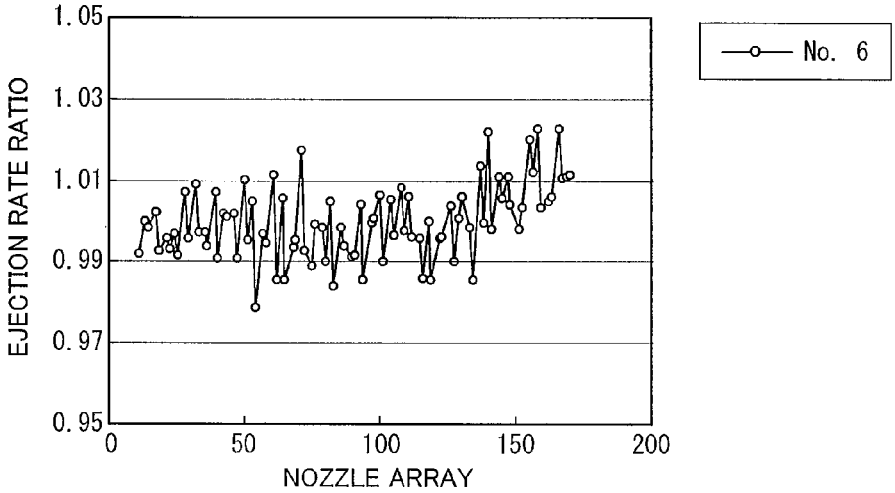
FIG. 16 is a diagram illustrating distribution of the ejection rates for each nozzle relating to a supply of a No. 6 drive signal.
Figure 17:
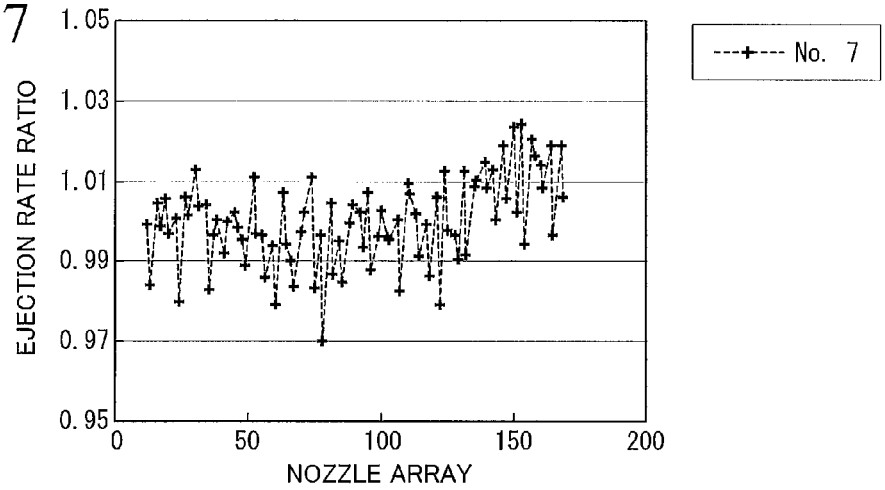
FIG. 17 is a diagram illustrating distribution of the ejection rates for each nozzle relating to a supply of a No. 7 drive signal.
Figure 18:
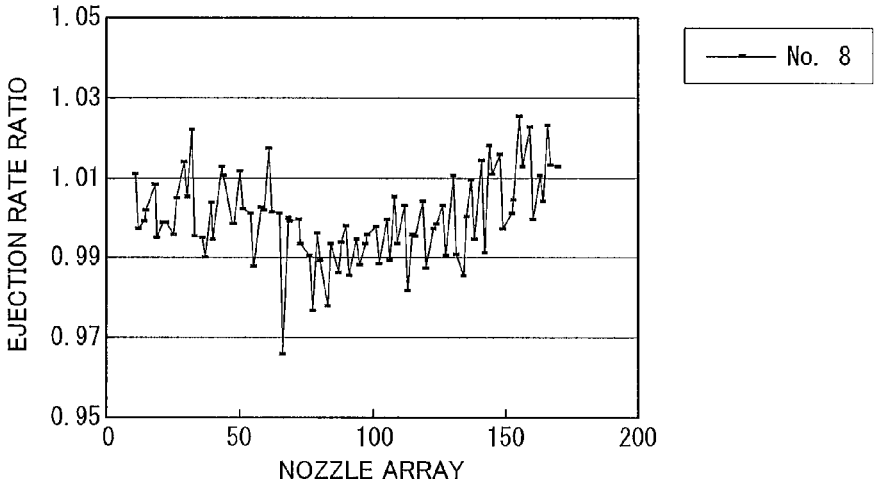
FIG. 18 is a diagram illustrating distribution of the ejection rates for each nozzle relating to a supply of a No. 8 drive signal.
Figure 19:
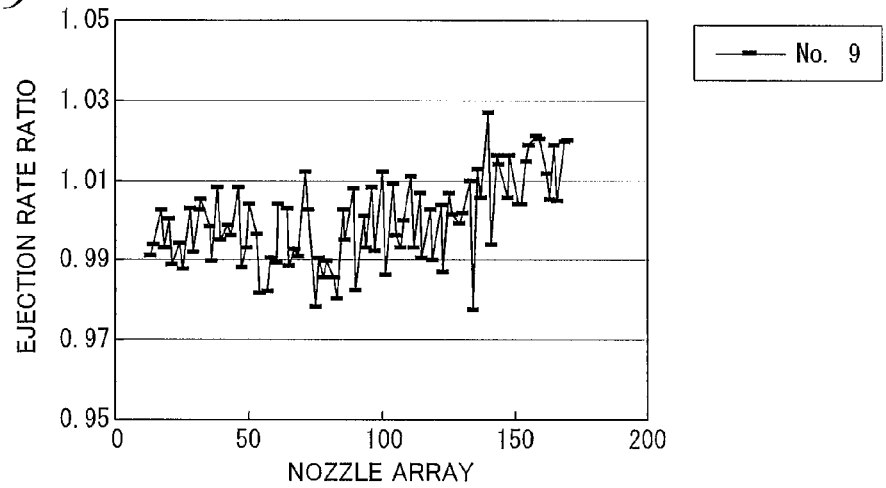
FIG. 19 is a diagram illustrating distribution of the ejection rates for each nozzle relating to a supply of a No. 9 drive signal.
Figure 20:
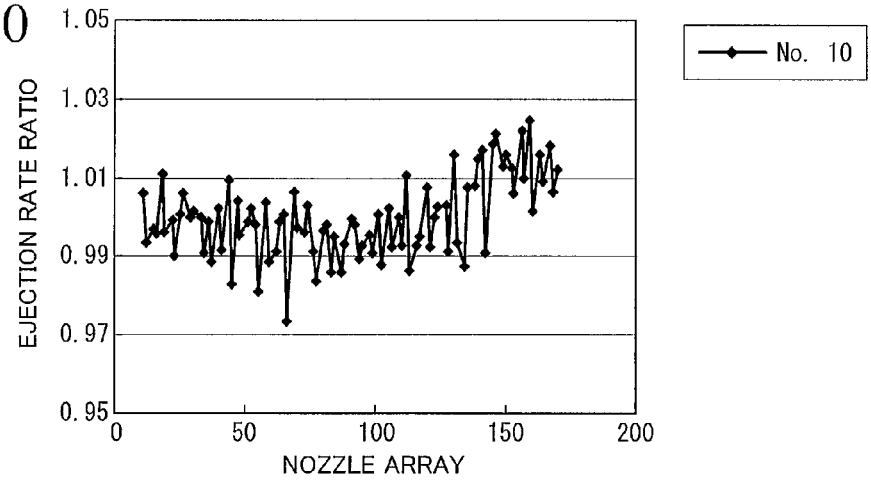
FIG. 20 is a diagram illustrating distribution of the ejection rates for each nozzle relating to a supply of a No. 10 drive signal.
Figure 21:
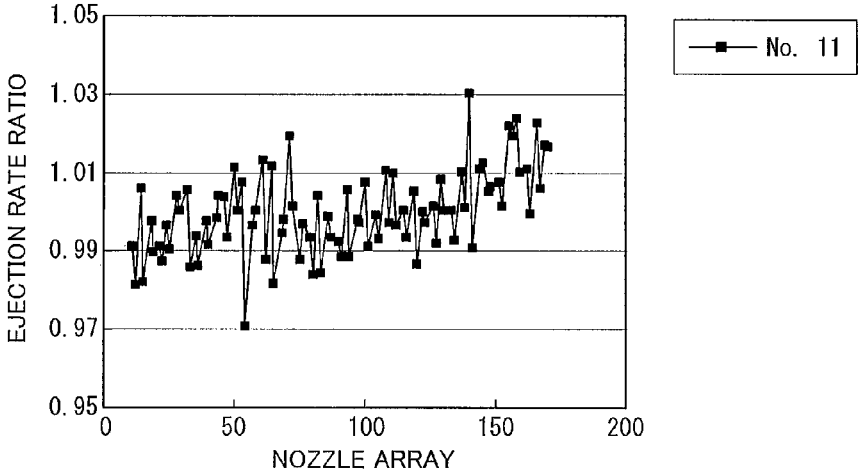
FIG. 21 is a diagram illustrating distribution of the ejection rates for each nozzle relating to a supply of a No. 11 drive signal.
Figure 22:
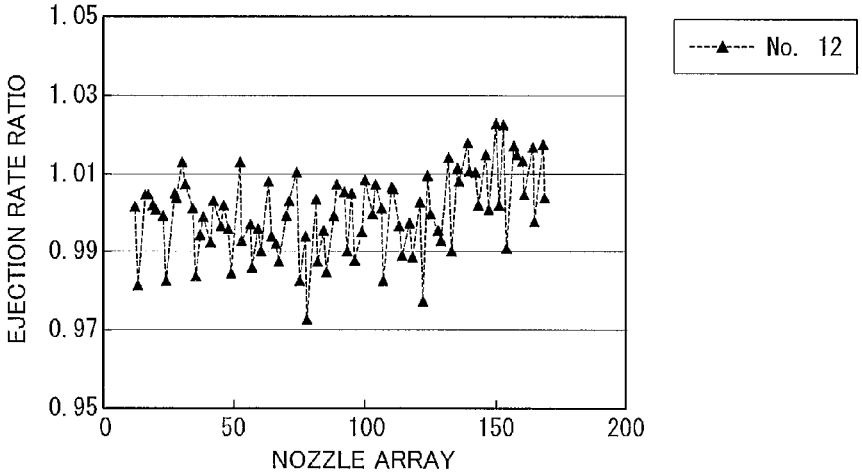
FIG. 22 is a diagram illustrating distribution of the ejection rates for each nozzle relating to a supply of a No. 12 drive signal.
Figure 23:
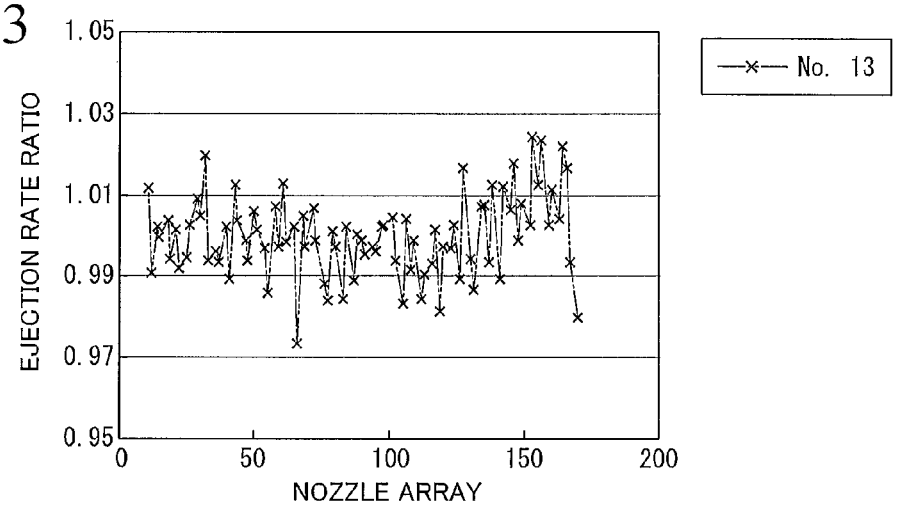
FIG. 23 is a diagram illustrating distribution of the ejection rates for each nozzle relating to a supply of a No. 13 drive signal.
Figure 24:
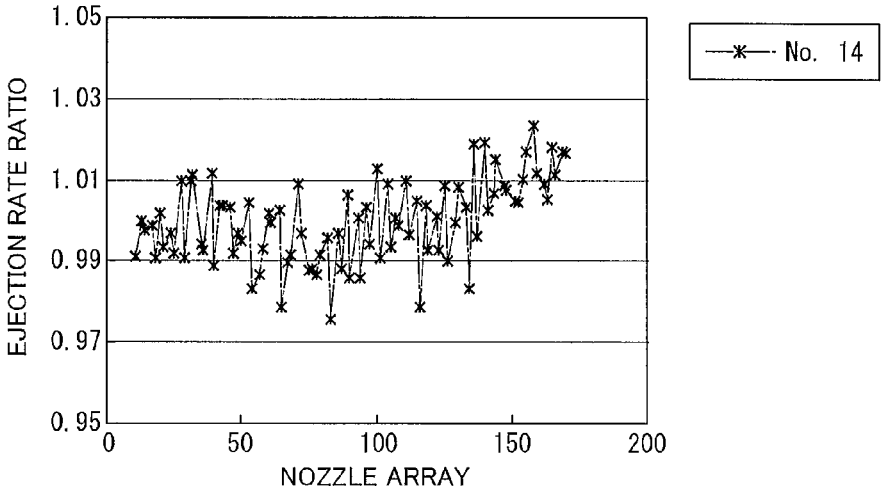
FIG. 24 is a diagram illustrating distribution of the ejection rates for each nozzle relating to a supply of a No. 14 drive signal.
Figure 25:
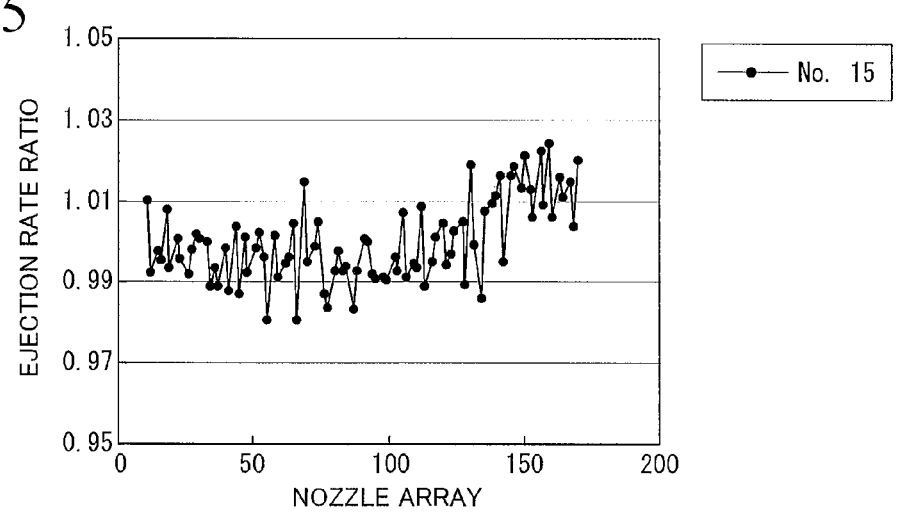
FIG. 25 is a diagram illustrating distribution of the ejection rates for each nozzle relating to a supply of a No. 15 drive signal.
Figure 26:
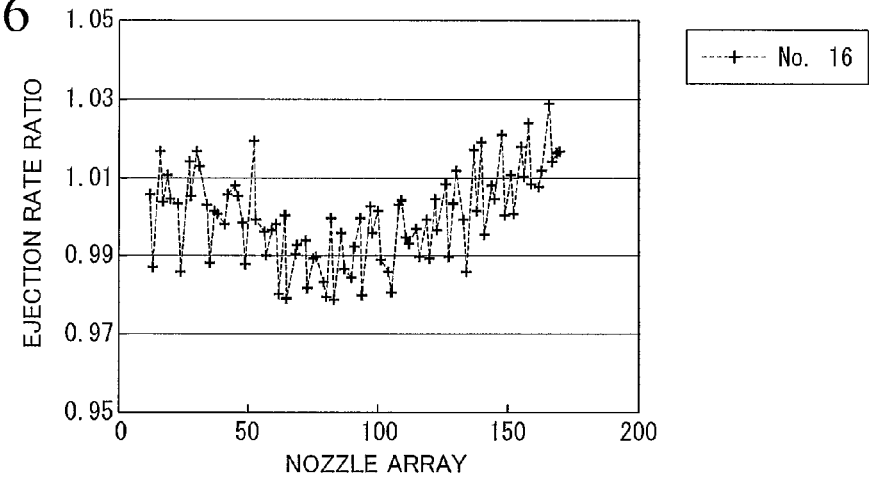
FIG. 26 is a diagram illustrating distribution of the ejection rates for each nozzle relating to a supply of a No. 16 drive signal.
Figure 27:
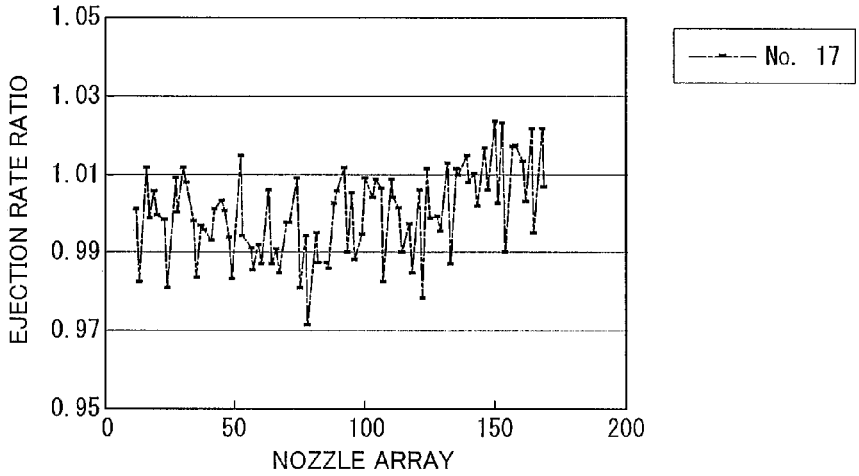
FIG. 27 is a diagram illustrating distribution of the ejection rates for each nozzle relating to a supply of a No. 17 drive signal.
Figure 28:
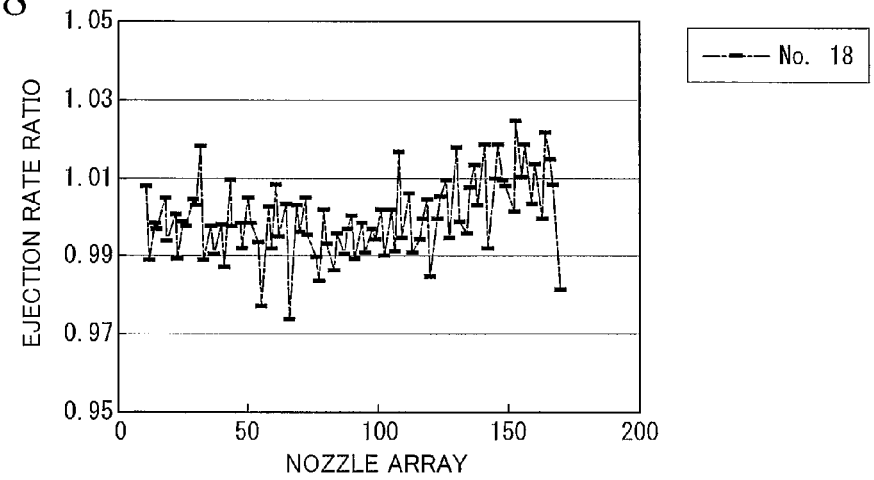
FIG. 28 is a diagram illustrating distribution of the ejection rates for each nozzle relating to a supply of a No. 18 drive signal.
Figure 29:
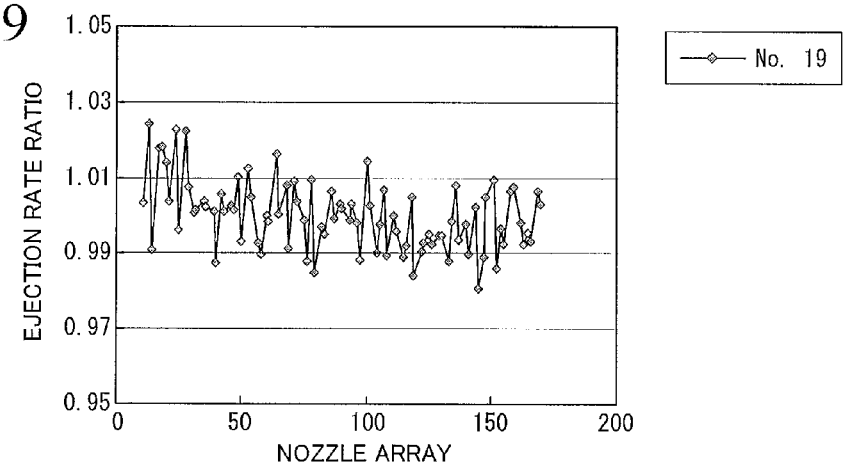
FIG. 29 is a diagram illustrating distribution of the ejection rates for each nozzle relating to a supply of a No. 19 drive signal.
Figure 30:
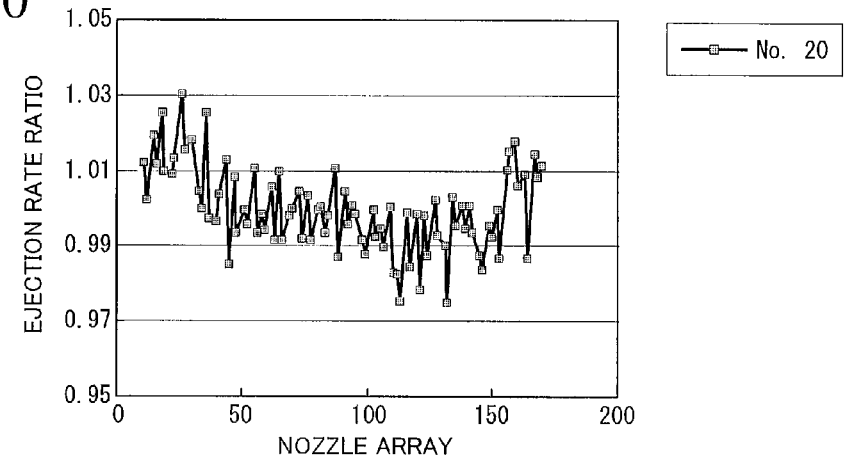
FIG. 30 is a diagram illustrating distribution of the ejection rates for each nozzle relating to a supply of a No. 20 drive signal.

FIG. 10B is a diagram illustrating distribution of the average values (Ave.) of the ejection rates for each nozzle. The average values are calculated based on the data of the No. 1 to 20 drive signals.

In addition, FIGS. 11 to 30 are diagrams separately illustrating the data of each of the No. 1 to 20 drive signals shown in FIG. 10A.

As shown in FIG. 10A, when a liquid is actually ejected from the nozzles to a receiving medium, since the drive signals under the plurality of the conditions are set and supplied for each nozzle (each driving element), it is understood that an occurrence of variation in the ejection rates is indicated caused by a difference in frequency of use of the nozzles.

In contrast, as shown in FIG. 10B, since the average value (median value) of the ejection rates for each nozzle relating to the drive signal under a plurality of conditions is calculated, and since the waveform of the drive signals is controlled using this data, it is possible to uniformly eject the liquid.

The grouping process, especially the selection of the number of nozzles constituting the groups is not limited to the aspects described above.

However, since the drive voltage Vh is set up on a group basis, selecting a substantially equal number of nozzles constituting each group may redress imbalance in the number of nozzles corresponding to each of the proper drive voltages, i.e., each COM line.

Since the number of nozzles corresponding to the COM line may affect, for example, the distortion of the drive signals, it is preferable that the imbalance between the COM lines is redressed. In view of this point, the embodiments have been provided.

The invention is not limited to the embodiments described above.

Another example of placement of a liquid using the liquid ejection head according to the invention may include production of a fluorescent screen for a plasma display device, production of an element film for an organic electroluminescence display and production of conductive wiring and resistive elements for an electric circuit.

Configurations of the above-described embodiments can be used in combinations thereof, in combination with another unillustrated configuration, or may alternatively be omitted.

What is claimed is:

1. A method for setting up a condition for a drive signal in a liquid ejection head that includes a plurality of linearly-arranged nozzles and driving elements provided for each of the nozzles, a liquid being ejected from the nozzles to a receiving medium when the drive signal is supplied to the driving elements, the method comprising:

ejecting liquids from the nozzles by applying a first drive voltage, measuring ejection rates of the liquids, and obtaining a first average ejection rate of the liquid ejected from the nozzles;

ejecting liquids from the nozzles by applying a second drive voltage different from the first drive voltage, measuring ejection rates of the liquids, and obtaining a second average ejection rate of the liquid ejected from the nozzles;

calculating a reference drive voltage used for obtaining an average ejection rate at a reference ejection rate by using a relationship between the first drive voltage and the first average ejection rate and by using a relationship between the second drive voltage and the second average ejection rate, calculating a rate of change of the average ejection rate with respect to drive voltage as a correlation coefficient for a correction of the ejection rate using the drive voltage;

supplying a first drive signal to the driving elements, ejecting the liquid from each nozzle, measuring a droplet formed by the ejected liquid, analyzing the measured data, and obtaining a first ejection rate of each nozzle;

supplying a second drive signal to the driving elements, the second drive signal being different from the first drive signal, ejecting the liquid from each nozzle, measuring the droplet formed by the ejected liquid, analyzing the measured data, and obtaining a second ejection rate of each nozzle;

calculating an average value or a median value of ejection rates of each nozzle using the first ejection rate and the second ejection rate;

classifying the nozzles into a plurality of groups in accordance with the order of the average value or the median value of the ejection rates of each nozzle;

calculating proper drive voltages that cause a statistical value of the ejection rates of one of the groups to correspond to the reference ejection rate on a group basis using the average value or the median value of the ejection rates of each nozzle, the correlation coefficient, and the reference drive voltage; and setting up one of the proper drive voltages corresponding to a group as a drive voltage to drive one of the nozzles.

2. The method according to claim 1, wherein when setting up the one of the proper drive voltages, one proper drive voltage that corresponds to a group relating to the statistical value closest to the ejection rate of the one nozzle is selected so as to set the selected proper drive voltage for that nozzle.

3. The method according to claim 1, wherein each of the groups is configured by substantially an equal number of nozzles.

4. The method according to claim 1, wherein the statistical value of the ejection rates relating to a group is an average value of the ejection rates of the nozzles in the group.

5. The method according to claim 1, wherein the statistical value of the ejection rates relating to a group is a median value of the ejection rates of the nozzles in the group.

6. The method according to claim 1, wherein when the first average ejection rate is obtained and when the second average ejection rate is obtained, a weight of the ejected liquid is measured using a weight measuring device.

7. The method according to claim 1, wherein when the first ejection rate of each nozzle is obtained and when the second ejection rate of each nozzle is obtained, a volume of the droplet formed by the liquid ejected from each nozzle is measured using a volume measuring device.

* * * * *